United States Patent [19]

Iwama et al.

[11] 4,234,671

[45] Nov. 18, 1980

[54] COLOR DIFFUSION TRANSFER DYE MORDANT

[75] Inventors: Hideaki Iwama, Tachikawa; Mikio Koyama, Tokorosawa; Masao Asano; Yasuo Tsuda, both of Tokyo, all of Japan

[73] Assignee: Konishiroku Photo Industry Co., Ltd., Tokyo, Japan

[21] Appl. No.: 21,800

[22] Filed: Mar. 19, 1979

[30] Foreign Application Priority Data

Mar. 20, 1978 [JP] Japan ..... 53/32100

[51] Int. Cl.[2] ..... G03C 1/40

[52] U.S. Cl. ..... 430/213; 430/941

[58] Field of Search ..... 96/29 D, 77, 84 A, 114, 96/119 R; 428/521, 500; 430/213, 941, 536

[56] References Cited

U.S. PATENT DOCUMENTS

| | | | |
|---|---|---|---|
| 2,798,063 | 7/1957 | Fowler et al. | 260/80.5 |
| 3,148,061 | 9/1964 | Haas | 96/29 D |
| 3,249,393 | 5/1966 | Haas et al. | 96/77 |
| 3,460,941 | 8/1969 | Haas | 96/29 D |
| 3,958,995 | 5/1976 | Campbell et al. | 96/77 |

*Primary Examiner*—Richard C. Schilling

*Attorney, Agent, or Firm*—Haseltine, Lake & Waters

[57] ABSTRACT

A dye image-receiving layer in a diffusion transfer image-receiving sheet comprises a novel mordant polymer which is a copolymer of 4-vinylpyridine, a monomer containing at least 2 ethylenically unsaturated groups and a monomer containing an $\alpha,\beta$-ethylenically unsaturated group. The polymer has excellent film-forming properties without the use of a solvent and does not require any film hardener.

3 Claims, No Drawings

COLOR DIFFUSION TRANSFER DYE MORDANT

This invention relates to color diffusion transfer photographic materials. More particularly, the invention is concerned with color diffusion transfer photographic materials which are excellent in film forming property, particularly in the property of being coated, and in which a novel polymer mordant is excellent in mordant effect.

In the color diffusion transfer process, a photosensitive element containing a silver halide emulsion and a dye image forming substance is imagewise exposed to light, whereupon a latent image is formed in the silver halide, and the exposed photosensitive element is subjected to development treatment with a processing agent (an alkaline processing solution). At the time of development with this processing agent, the exposed photosensitive element containing the dye image forming substance is in a state of being superposed on an image receiving element having an image receiving layer capable of acting as a mordant, and the dye image forming substance is transferred by diffusion onto the image receiving layer to obtain a dye image thereon.

As examples of the color diffusion transfer process, there may be mentioned a process disclosed in U.S. Pat. No. 2,983,606 wherein a dye developer, which is a dye having an ability of developing silver halide as well as capable of developing a silver halide emulsion, is used as a dye image forming substance, and a process disclosed in U.S. Pat. Nos. 2,647,049 and 2,774,668 wherein a color developer is used to develop a latent image and thereby to release a dye image forming substance. In such color diffusion transfer processes, there is used an image receiving element which has an opaque or transparent support and thereon an image receiving layer comprising a water- and alkali-permeable polymer mordant. Poly-4-vinylpyridine disclosed in U.S. Pat. No. 3,148,061 or various vinyl type quaternary salt polymers disclosed in British Pat. No. 1,261,925 are known as the polymer mordant to be incorporated into the image receiving layer as mentioned above.

The former poly-4-vinylpyridine, however, is generally water-insoluble and hence must be made water-soluble by the addition of an acid when it is used. In addition thereto, it is markedly difficult to form a uniform and homogeneous coating from a coating liquid of such polymer mordant because the coating liquid is very high in viscosity and, moreover, after formation of the coating with difficulty the acid such as acetic acid used in the coating liquid often remains in the resulting coating to generate a strong irritating odor, and removal of the remaining acid results in the necessity of aging the coating at 70°-80° C.

In order to improve the above-mentioned coating in film strength, it is well known to incorporate a film hardener into a coating liquid of said coating. The hardeners which are commonly used in the field concerned generally function in the neutral or alkali region. On the other hand, the aforesaid poly-4-vinylpyridine tends to become water-insoluble and deposit when it is in the neutral or alkali region and in that case brings about aggregation through its interaction with a hydrophylic binder such as gelatin. On this account, it is very difficult to use the hardener in combination with said poly-4-vinylpyridine.

Further, the latter vinyl type quaternary salt polymers have such drawbacks that because of having cation sites they tend to undergo interaction with a binder such as gelatin and thereby to bring about an increase in viscosity of a coating liquid containing said polymer.

Apart from the foregoing, water-insoluble polymer mordants which require an organic solvent such as alcohol when they are used in a coating liquid for the image receiving layer are disclosed in Belgian Pat. No. 820,394 to Cohen et al. granted Mar. 26, 1975. Although such mordants are excellent in ability to retain dyes to be fixed on the image receiving layer, they have such drawbacks that the necessity of the use of such organic solvents as aforesaid brings about increasing production costs and removal of the organic solvent used is needed and, at the same time, the step of coating a coating liquid containing said mordant must be carried out independently from that of coating other aqueous coating liquids because the former coating liquid is difficult to be coated simultaneously with the latter.

The present invention has been intended to overcome such drawbacks as mentioned above, and a primary object of the invention is to provide color diffusion transfer photographic materials having incorporated therein novel polymer mordants which are excellent in film forming properties, particularly the property of being readily coated, and which are capable of forming uniform and homogeneous layers comprising said polymer mordants.

A secondary object of the present invention is to provide color diffusion transfer photographic materials having incorporated therein novel polymer mordants which are excellent in film forming properties, said polymer mordants requiring no organic solvents in which said mordants are to be dissolved prior to coating and requiring no addition thereto of any film hardeners.

A third object of the present invention is to provide color diffusion transfer photographic materials which are excellent in mordant characteristics and particularly capable of shortening the dye image forming time and which give dye images favorable in minimum density.

The above-mentioned objects of the present invention and other objects thereof which will be mentioned later may be accomplished by the use of a color diffusion transfer photographic material as provided according to the invention, said photographic material comprising a support, at least one dye mordant-containing layer which contains a dye mordant and at least one dye image forming substance-containing layer which contains a dye image forming substance, characterized in that said dye mordant-containing layer contains a water-dispersible particulate polymer mordant which comprises monomer units as represented in the following general formula:

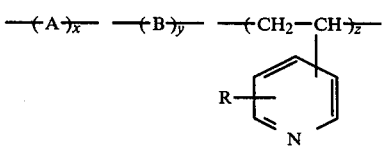

General formula

In the general formula, A is an addition polymerizable monomer unit containing at least 2 ethylenically unsaturated groups, B is a copolymerizable $\alpha,\beta$-ethylenically unsaturated monomer unit, R is a hydrogen atom or a methyl or ethyl group, x, y and z individually represent mole proportion, and x is 0–5 mol%, y is 0–90 mol% and z is 10–100 mol%.

The water-dispersible particulate polymer mordant (hereinafter called "the present polymer mordant") comprising monomer units as represented in the above-mentioned general formula are explained hereinafter.

The present polymer mordant which is preferably usable is a polymer, the monomer unit (A) of which is a recurring unit of an addition polymerizable monomer containing two ethylenically unsaturated groups. Preferable examples of the ethylenically unsaturated group as referred to above include such groups as represented by the general formula (I).

General formula (I)

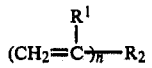

In the general formula (I), n is an integer greater than 1, preferably 2 or 3, $R_1$ is independently selected from a hydrogen atom and a methyl group, and $R_2$ is one or more condensed linking groups, for example, such linking groups as comprising, for example, an amido group, a sulfonamido group, an ester group, e.g. a sulfonic acid ester group, or an arylene group and an organic nucleus, for example, an alkylene group, e.g. methylene, ethylene and trimethylene, and an arylene group, e.g. phenylene, phenylenebis(oxycarbonyl), 4,4'-isopropylidenebis(oxycarbonyl), 1,2,4-propanetolyltris(oxycarbonyl), cyclohexylenebis(methyleneoxycarbonyl), methyleneoxymethylenecarbonyloxy, ethylenebis(oxyethyleneoxycarbonyl) and ethylidynetrioxycarbonyl.

The monomer used must be stable even in the presence of strong alkali and also must not be high in reactivity so that it does not undergo hydrolysis during the process of copolymerization.

Suitable examples of the polymerizable monomer forming the recurring unit (A) include divinylbenzene, allyl acrylate, allyl methacrylate, N-allyl methacrylamide, 4,4'-isopropylidene diphenyl diacrylate, 1,3-butylene diacrylate, 1,3-butylenedimethacrylate, 1,4-cyclohexylene-dimethylene dimethacrylate, diethylene glycol dimethacrylate, diisopropylene glycol dimethacrylate, divinyloxymethane, ethylene diacrylate, ethylene dimethacrylate, ethylidene diacrylate, ethylidene dimethacrylate, 1,6-diacrylamidohexane, 1,6-hexamethylene diacrylate, 1,6-hexamethylene dimethacrylate, N,N'-methylenebisacrylamide, neopentyl glycol dimethacrylate, phenylethylene dimethacrylate, tetraethylene glycol dimethacrylate, tetramethylene diacrylate, tetramethylenedimethacrylate, 2,2,2-trichloroethylidene dimethacrylate, triethylene glycol diacrylate, trimethylene glycol dimethacrylate, ethylidene trimethacrylate, propylidene triacrylate, vinylallyloxy acetate, vinyl methacrylate and 1-vinyloxy-2-acryloxy ethane. Of the monomers mentioned above, particularly preferable in divinylbenzene.

Furthermore, (B) in the aforesaid general formula is a unit (provided that this unit includes 2, 3 or more recurring units) of a copolymerizable $\alpha,\beta$-ethylenically unsaturated monomer, for example, saturated aliphatic carboxylic acid vinyls such as vinyl acetate and vinyl butyrate, acrylic acid esters such as methyl acrylate, ethyl acrylate, n-butyl acrylate, methyl methacrylate, n-butyl methacrylate, methyl $\alpha$-chloroacrylate, 2-hydroxyethyl acrylate and 2-N,N-dimethylaminoethyl acrylate, olefins such as ethylene, propylene and isobutylene, halogenated olefins such as vinyl chloride and vinylidene chloride, dienes such as butadiene and isoprene, nitriles such as acrylonitrile and methacrylonitrile, aromatic unsaturated hydrocarbons such as styrene, methyl styrene and chloromethyl styrene, acrylamides such as acrylamide, methacrylamide, N-methylacrylamide, N,N-dimethylacrylamide and diacetone acrylamide, vinyl ethers such as vinyl methyl ether and vinyl ethyl ether, N-vinylpyrrolidone, and fluorinated vinyl compounds such as $CF_2{=}CF_2$,

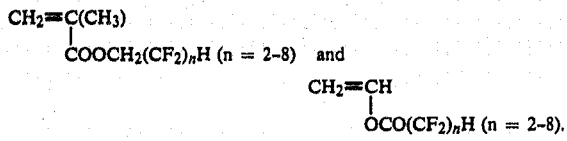

In vinylpyridine and derivatives thereof, i.e. mordant monomers as represented in the aforesaid general formula, R is independently selected from a hydrogen atom, methyl and ethyl groups, and concretely these compounds include 2-vinylpyridine, 3-vinylpyridine, 4-vinylpyridine, 2-methyl-5-vinylpyridine, 2-methyl-6-vinylpyridine, 5-ethyl-2-vinylpyridine, etc. The monomer particularly excellent in mordant performance is 4-vinylpyridine.

The mole proportions of x, y and z, respectively, in the aforesaid general formula are preferably such that x is about 1 to about 3 mol%, y is about 7 to about 49 mol%, and z is about 50 to 90 mol%.

The present polymer mordant can be prepared by subjecting the above-mentioned vinylpyridine or its derivative, together with the aforesaid poly unsaturated monomer (A) and $\alpha,\beta$-ethylenically unsaturated monomer (B), to emulsion polymerization. In the light of the fact that generally vinylpyridine and derivatives thereof have a positive charge in an acidic condition generally used for the polymerization of this type of monomers and become water-soluble by salt-formation with anionic surface active agents, it is considered that cationic surface active agents or nonionic surface active agents or the combination thereof are used in this emulsion polymerization so that no mismatching in electric charge between the surface active agent and the vinylpyridine or its derivative will occur. In this case, however, it is known in the field of photography that the above-mentioned surface active agents markedly hinder the light-sensitive silver halide photographic material in its photographic characteristics. This polymerization can be accomplished by allowing the polymerization system to proceed to polymerization under a neutral or acidic condition in the presence of an anionic surface active agent, for example, a sodium salt of a sulfuric acid condensate of sodium lauryl sulfate alkylphenol with ethylene oxide, such a commercially available surface active agent, for example, as being sold under the trade name Triton-770, as 30% solution, by Rohm & Haas, a redox free radical polymerization initiator, for example, potassium persulfate, sodium hydrogen sulfite or potassium persulfate-$Fe^{2+}$, or a water-soluble azo type radical polymerization initiator, for example, a 2,2'-azobis-(aminodipropane) dimineral acid salt, azobis(cyanovaleric acid) and salts thereof.

The present polymer mordant is in a particulate form and water-dispersible. The term water-dispersible as used herein is intended to designate such a state that the dispersion of the present polymer mordant, when it is seen with the naked eye, appears to be a solution which is slightly turbid though translucent, however, when subjected to electron microscopic observation, the polymer mordant is present in a particulate form dispersed in an aqueous dispersion medium.

The present polymer mordant generally has a particle diameter of about 0.04μ to about 0.15μ, and in a preferred embodiment there are used those as having a particle diameter ranging from 0.05μ to 0.08μ.

The present polymer mordant is very easily prepared since the whole process for the preparation thereof can be performed within one vessel. Because the preparation of the present polymer mordant relies on emulsion polymerization, the conversion of the monomers into the polymer is very high and such polymer as prepared can be used, as it is, in the preparation of the coating liquid thereof without necessitating such an operation as removing residual unaltered monomers as in the case of solution polymerization or without subjecting the polymer as formed to such steps as precipitation with large amounts of lean solvents purification and drying.

Usable as the present polymer mordants are the following exemplified polymers of certain kinds having their respective units as mentioned below.

(Exemplified compound)

(1)

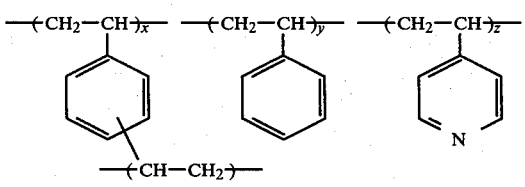

x:y:z = 2:49:49

(2)

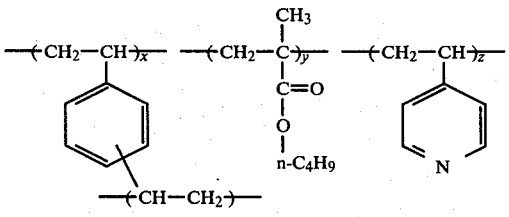

x:y:z = 2:49:49

(3)

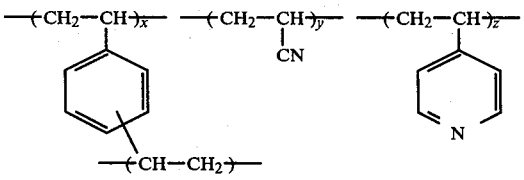

x:y:z = 2:59:39

(4)

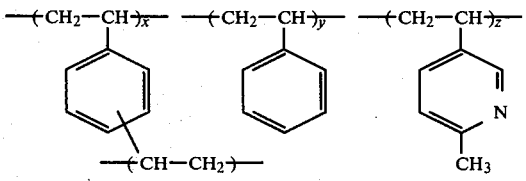

x:y:z = 1:50:49

-continued (Exemplified compound)

(5)

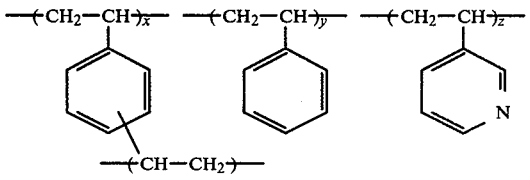

x:y:z = 3:37:60

(6)

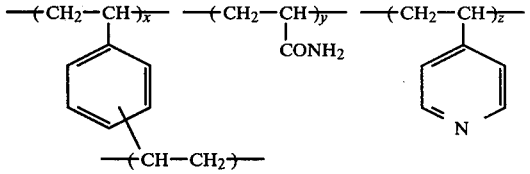

x:y:z = 1:10:89

(7)

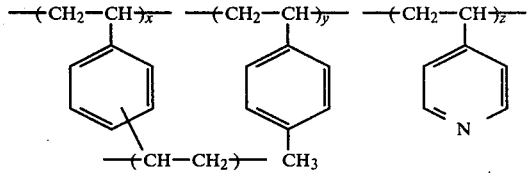

x:y:z = 2:49:49

(8)

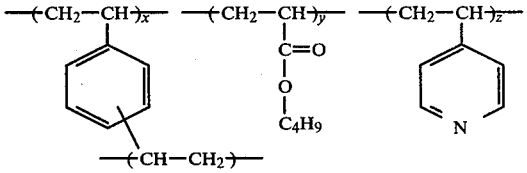

x:y:z = 1:30:69

(9)

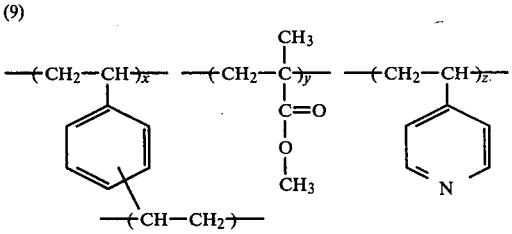

x:y:z = 3:40:57

(10)

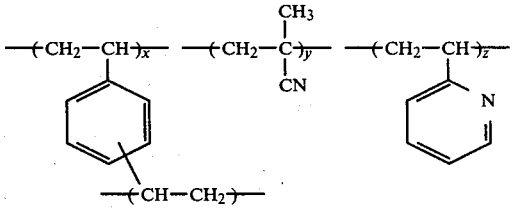

x:y:z = 2:49:49

-continued (Exemplified compound)

(11)

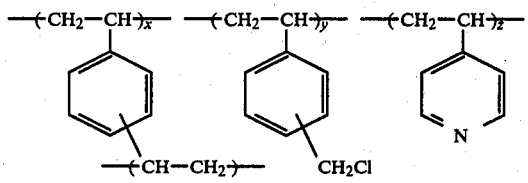

x:y:z = 1:20:79

(12)

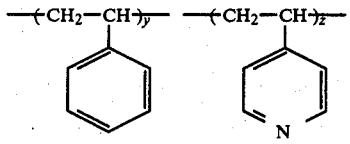

y:z = 50:50

(13)

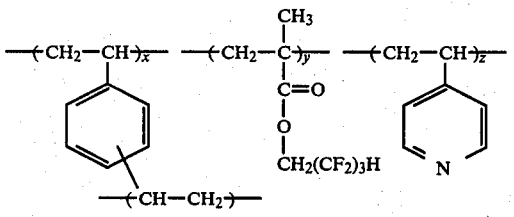

x:y:z = 2:49:49

(14)

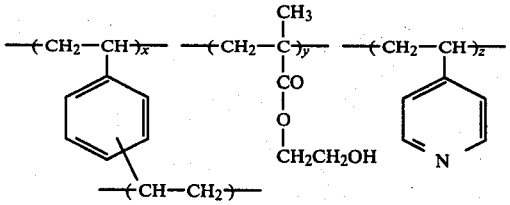

x:y:z = 3:35:62

(15)

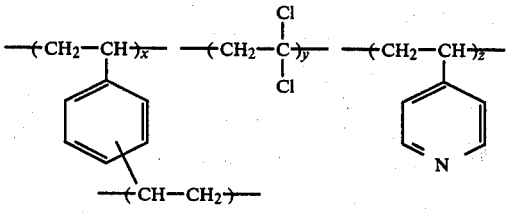

x:y:z = 4:20:76

The layer which contains the present polymer mordant may be used as an image receiving layer and/or a scavenger layer. The image receiving layer may be incorporated with various additives. Such additives include, for example, ultraviolet absorbers such as substituted-2-hydroxyphenylbenzotriazole (known under the trade name of Tinuvin) or antioxidants such as tertiary butyl hydroxyanisole, butyrated hydroxytoluene, substituted chromanole, etc.

As mentioned above, the layer containing the present polymer mordant is used as the image receiving layer and/or the scavenger layer. In the case where the present polymer mordant containing layer is used as the image receiving layer of the image receiving element, it is sufficient to form as an image receiving layer the layer containing the present polymer mordant on a support of said image receiving element. It is desirable to use the present polymer mordant in the form of being dispersed in a substantially aqueous medium solution (hereinafter called "the present polymer mordant solution") by applying the same for forming the layer thereof on a support of the image receiving element, said support having been coated on the surface with such layers, for example, as a timing layer, overcoat layer, neutralization layer, intermediate layer and the like. In that case, however, it may also be possible to use the present polymer mordant solution by applying the same directly onto the support without forming such layers as neutralization, intermediate and the like layers referred to above.

In case where a layer containing the present polymer mordant is used as a scavenger layer, on the one hand, the layer containing the present polymer mordant may be formed as the scavenger layer in any of such photographic elements as an image receiving element, processing sheet and photosensitive element. The present polymer mordant or a solution thereof may be coated to form a scavenger layer containing said mordant or said solution between a photosensitive layer (a silver halide emulsion layer) and a support of a photosensitive element or between said photosensitive layer and an image receiving layer when a color diffusion transfer photographic material is designed so as to have such layer positioning, for example, as disclosed in the specifications of U.S. Pat. Nos. 3,415,644, 3,473,925, 3,573,043, 3,573,042 and 3,615,421. Alternatively, it is also possible that the present polymer mordant or a solution thereof is incorporated into a coating liquid used for forming the aforesaid intermediate or neutralization layer and the thus formed intermediate or neutralization layer is used as a scavenger layer. Further, it is also possible that a layer containing the present polymer mordant is used in a processing sheet as a scavenger layer when a color diffusion transfer photographic material is designed so as to have such layer positioning as disclosed in the specifications of U.S. Pat. Nos. 3,415,645, 3,415,646, 3,594,164 and 3,594,165.

The present polymer mordant not only hardens by itself to form a film capable of acting as a mordant but also can be used in combination with other binder to form a film capable of being as a mordant. Suitable binders include, as non-restricted representatives, such water-soluble polymers, for example, as gelatin, polyvinyl alcohol, carboxymethylcellulose, hydroxyethylcellulose, starch, polyacrylamide, polyvinyl pyrrolidone, etc. When the above-mentioned polymer is used in combination with the present polymer mordant, they are used in any proper proportion. When the present polymer mordant is incorporated into an image receiving layer, the content in the image receiving layer of the present polymer mordant is preferably in the range of 10 to 100% by weight, and the present polymer mordant is desirably used in similar proportion even when it is incorporated into a scavenger layer and other layer capable of acting as a mordant.

In forming a layer containing the present polymer mordant, the thickness thereof may have varying thickness according to the purpose for which the layer is used. For instance, when the said layer is used as an image receiving layer, the optimum thickness of the layer is about 3 to about 10$\mu$, and when the said layer is used as a scavenger layer, the thickness of the layer is desirably 0.5 to 10μ.

In the present invention, a processing sheet may be used according to layer positioning of the photographic element, and there may be used various processing sheets, such as a processing sheet used for the purpose of shielding the light and/or for the purpose of uniformly distributing a processing composition and thereby to effect the diffusion favorably. In the case of the former purpose, any sheets can be used so long as they can shield the light, and in the case of the latter, any sheets can be used irrespective of transparency so long as they are capable of uniformly distributing the processing composition and of effecting the diffusion. When a scavenger layer is intended to form on the processing sheet, a layer containing the present polymer mordant may be provided on the support of said processing sheet, and in case a neutralization layer and/or an intermediate layer is intended to form on the processing sheet, the present polymer mordant may be incorporated into said layer and the layer so incorporated may be used as a scavenger layer. Support for the processing sheet may be any of those used for an image receiving element which will be mentioned later, and the support may be selected according to the purpose for which the processing sheet is used. In the case of the processing sheet used for shielding the light, such pigment as carbon black or titanium oxide may be incorporated into a support for said processing sheet, or such pigment may be coated on the support using a binder, if necessary.

The image receiving element referred to previously is face to face with the exposed photosensitive element for the color diffusion transfer process, and a processing composition (an alkaline processing solution) is spread therebetween to develop a silver halide emulsion and a dye image forming substance thereby available is transferred onto an image receiving layer, thereby obtaining a color image on said image receiving element.

In the definition of the aforesaid present polymer mordant solution, the expression "substantially aqueous" is intended to mean that the dispersion medium is occupied in its carrier portion by at least 90% by weight, preferably at least 95% by weight, of an aqueous system. The remaining portion of the carrier in the dispersion medium may consist of a water-miscible organic solvent, for example, an alcohol such as methanol, ethanol, isopropanol or the like.

The present polymer mordant solution is desirably used, for example, as a 2 to 20% solution.

Various materials may be used as supports for the above-mentioned image receiving element or photographic materials. According to the purpose for which the image receiving element or photographic material is used, there may be used, for example, baryta paper, papers laminated with resins such as polyethylene, etc., sheets made of cellulose organic acid esters such as cellulose diacetate, cellulose triacetate, cellulose acetate butyrate, etc., sheets made or inorganic acid esters such as cellulose nitrate, etc., sheets made of polyesters such as polyethylene terephthalate, etc., sheets made of polyvinyl esters such as polyvinyl acetate, etc., sheets made of polyvinyl acetals such as polyvinyl acetal, etc., and sheets made of polyalkylenes such as polystyrene, polypropylene, polyethylene, etc. The neutralization layer in the present invention may be any layer containing a neutralizer and capable of lowering the pH within the system after development treatment. Preferably usable as the neutralizers are film forming polymer acids having at least one carboxyl group, sulfone group or a group forming a hydroxyl group on hydrolysis, and any of such polymer acids is usable. The polymer acid used in the present invention has a molecular weight of preferably from about 10,000 to about 100,000, for example, the monobutyl ester of a 1:1 copolymer of maleic anhydride and ethylene, the monobutyl ester of a 1:1 copolymer of maleic anhydride and methyl vinyl ether, and the monoethyl ester, monopropyl ester, monopentyl ester and monohexyl ester of the former copolymer and the monoethyl ester, monopropylester, monopentyl ester and monohexyl ester of the latter copolymer, copolymers of polyacrylic acid, copolymers of polyacrylic acid, polymethacrylic acid and acrylic acid and methacrylic acid in varying proportions, and copolymers of acrylic acid or methacrylic acid and with other vinyl type monomers in varying proportions, said monomers including, e.g. esters of acrylic acid, esters of methacrylic acid, vinyl ethers, etc., and said copolymers containing at least 30 mol%, preferably 50 to 90 mol%, of acrylic acid or methacrylic acid. In addition thereto, there may also be used, if necessary in combination with binder polymers, such materials, for example, as metal salts, monomer acids, ballasted organic acids, alkyl phosphates, polyalkyl phosphate, poly(1-acryloyl-2,2,2-trimethylhydrazinium-p-toluenesulfonate), etc. If necessary, the polymer acids may be used in combination with monomer acids or organic amines. These polymer acids, monomer acids, organic amines and binder polymers may be dissolved in solvents, for example, such alcohols as methanol, ethanol, propanol and butanol, such ketones as acetone, methyl ethyl ketone, diethyl ketone and cyclohexanone, such esters as methyl acetate, ethyl acetate, isopropyl acetate and butyl acetate, or mixtures thereof, and the resulting solution may be coated on the support to form a neutralization layer.

The thickness of this neutralization layer cannot specifically be defined because it varies according to the composition and amount of the alkaline processing composition used and to the kind of materials incorporated into the neutralization layer used, but generally the thickness range from 5 to 30μ is suitable.

The above-mentioned neutralization layer may be positioned at any place in the photographic material of the present invention for the color diffusion transfer process according to the layer positioning thereof. For instance, the neutralization layer may be provided between an image receiving layer and a support thereof, between a photosensitive layer and a support thereof, in a processing sheet or between the photosensitive layer and the support thereof and/or between the image receiving layer and the support thereof. When the layer positioning involves a peeling means, moreover, the neutralization layer may be provided between the image receiving layer and the support thereof.

In the present invention, there may be provided, together with the neutralization layer, an intermediate layer (a neutralization rate controlling layer) for the purpose of controlling the lowering of the pH within the system. This intermediate layer plays the role in retarding the drop in pH within the system before and after completion of the desired development and transfer. That is, the intermediate layer prevents an undesirable drop in density of the transferred image due to the quick lowering of pH within the system brought about by the neutralization layer before the development of the silver halide and formation of a diffusion transferred image.

Advantageously usable as materials for forming such intermediate layer are those of various kinds, for example, gelatin, polyvinyl alcohol, partially acetylated products of polyvinyl alcohol, partially hydrolyzed polyvinyl acetate, cyanoethylated polyvinyl alcohol, hydroxypropylmethylcellulose, isopropylcellulose, polyvinylamides, polyvinylamide-grafted copolymers and combinations of latex liquids and permeation agents.

The photosensitive element for the color diffusion transfer process comprises a support and thereon at least one silver halide emulsion layer and a dye image forming substance in combination with the silver halide present in said silver halide emulsion layer. In preparing this photosensitive element, it is particularly desirable to successively form on the support a red-sensitive emulsion layer, green-sensitive emulsion layer and blue-sensitive emulsion layer in that order and use a cyan dye image forming substance, magenta dye image forming substance and yellow dye image forming substance in combination with said emulsion layers, respectively. If necessary, the photosensitive element may be provided further with such layers as a yellow filter layer, antihalation layer, intermediate layer and protective layer. Desirably, the support used for the photosensitive element is a plane material which does not bring about a marked dimensional change during the period of processing said element with a processing composition. Generally, flexible supports are useful, though such a hard support as glass may be used according to the purpose for which the photosensitive element is used. Advantageously usable flexible supports are preferably those which are used for light-sensitive photographic materials in general, for example, cellulose nitrate films, cellulose acetate films, polyvinyl acetal films, polystyrene films, polyethylene terephthalate films and polycarbonate films, as mentioned previously. In the present invention, a water vapor permeable support is advantageously used in order to aid evaporation through the support of the water contained in the processing composition (an alkaline processing composition) distributed after the processing. Further, in order to prevent leaking of the light through the edge of transparent support to a silver halide emulsion layer when the photographic material is processed in the light place, the support is desirably colored to such an extent that transmission of the light in the plane direction can be prevented but the imagewise exposure and observation of the formed image are not hindered. If desired, the support may be incorporated with various photographic additives, for example, such plastisizers as esters of phosphoric acid and esters of phthalic acid, such ultraviolet absorbers as 2-(2-hydroxy-4-t-butylphenyl)benztriazole, and such antioxidants as hindered phenols. In order to maintain the adhesion between a support and a layer containing a hydrophilic polymer, it is of advantage to provide a sub-layer on the support or subject the support on the surface to such pretreatment as corona discharge, ultraviolet ray irradiation or flame treatment. Though not particularly limited in thickness, usually the support desirably has a thickness of 20 to 300$\mu$. When used for the purpose of shielding the light, the support may be incorporated, for example, with such pigments as carbon black and titanium oxide or, if necessary, may be coated on the surface with such pigments using binders.

The photographic materials according to the present invention for the color diffusion transfer process have a constitution, for example, such as that of an image transfer film unit mentioned below.

(1) A photosensitive element comprising a support having been coated thereon with at least one layer containing a dye image forming substance and a silver halide emulsion, (2) an image receiving layer containing the present polymer mordant is aforesaid, and (3) an alkaline processing composition containing means so prepared that its contents can be released therefrom within the film unit.

With regard to the dye image forming process applicable to the photographic materials of the present invention for the color diffusion transfer process, there is considerable variation in the method by which the dye image forming substance releases on development of the silver halide a diffusible dye or its precursor.

The first one, typical of such image forming processes, is the so-called dye developer method. The dye developer referred to in this method is a compound which has in one molecule both a dye moiety or its precursor and a silver halide developing group, wherein as a result of oxidation by silver halide of the dye developer as a dye image forming substance, reduction of the silver halide and oxidation of the dye developer take place, thereby bringing about a change in property of the dye developer from non-diffusible to diffusible in the presence of the processing composition. As compared with the dye developer in the reduced form, the oxidized dye developer has a low solubility and low diffusibility in the processing composition and is fixed in the vicinity of the reduced silver halide. Preferably the dye developer is substantially insoluble in an acidic or neutral aqueous medium, but has at least one residue dissociatable enough to render said dye developer soluble and diffusible in an alkaline environment of the processing composition. Such dye developer may be incorporated into a photosensitive element, particularly into a silver halide emulsion layer or layers adjacent thereto, and is used in a photosensitive element comprising a combination of a silver halide emulsion layer and a dye developer having a spectral absorption property corresponding to a photosensitive wavelength region of the silver halide of said silver halide emulsion layer. When diffusion transfer is effected from a photosensitive element having at least one photosensitive unit of the above combination to an image receiving element, a monochromatic or multicolor positive transfer image is obtained by development treatment for once. More particularly, in the color diffusion transfer process relying on the above-mentioned first typical method, a silver halide latent image in a photosensitive element is developed in the presence of a dye developer and, as a result of the development, the dye developer in the exposed area is oxidized and substantially fixed. This fixation is considered to rely at least partly on change in the solubility property of the dye developer at the time of oxidation, particularly the change in solubility in an alkaline solution. In the unexposed and partially exposed areas of the emulsion, the dye developer does not react yet and is diffusible and hence provides an imagewise distribution of the dye developer, which has not been oxidized yet, in the processing composition as a function of exposure point by point of the silver halide emulsion. At least a part of this imagewise distribution of the dye developer which has not been oxidized yet is transferred by inhibition onto an image receiving layer superposed so as to face the silver halide emulsion layer.

This transfer substantially excludes the oxidized dye developer. The image receiving element receives the imagewise diffusion from the developed emulsion of the unoxidized dye developer without practically disturbing the imagewise distribution of said unoxidized dye developer and thereby gives a reversed image of the developed image. Particularly useful dye developers in the diffusion transfer process of the first method are compounds, of which the silver halide developing groups have benzenoid groups, and preferable benzenoid groups in such compounds are hydroquinonyl groups. In the present invention, there may also be used hydrolyzable dye developers, into which hydrolyzable groups have been introduced, and shorter wavelength shift dye developers. In the present invention, moreover, there may effectively be used leuco dye developers, of which the dye moieties have been reduced to temporarily convert them into colorless leuco forms.

The second one, typical of the image forming processes, is a method which comprises using as a dye image forming substance a non-diffusible dye image forming substance which releases a diffusible dye or its precursor on coupling reaction with a color developing agent for silver halide which has been oxidized by silver halide.

In the above-mentioned second method, it is indispensable to use a silver halide color developing agent and usually p-phenylenediamine type compounds are used as the silver halide color developing agents.

In contrast to the above-mentioned first and second methods, there is the third one, typical of the image forming processes, which comprises using dye releasing redox compounds (hereinafter called "DRR compounds") which are non-diffusible dye image forming substances and which can release on oxidation with an oxidation product of a silver halide developing agent diffusible dyes or precursors thereof in an alkaline medium.

Further, the fourth typical method is to use non-diffusible dye image forming substances which are hindered in their releasing diffusible dyes or precursors thereof in an alkaline medium on reaction with an oxidation product of a silver halide developing agent.

The above-mentioned third and fourth methods possess an advantage over the above-mentioned first and second methods in that since the portion to be transferred onto the image receiving layer consists only of a diffusible dye moiety or its precursor and has no moiety of the silver halide developing agent and a black and white silver halide developing agent can be used in preferred embodiments while the use of p-phenylenediamine type compounds as color developing agents is not indispensable, dye images having less color stain are obtained.

In the above-mentioned third method, i.e. the so-called DRR process, a photosensitive element comprising a light-sensitive silver halide emulsion layer and in combination therewith a non-diffusible dye image forming substance, i.e. DRR compound, is exposed to light, thereby forming a latent image in said light-sensitive silver halide emulsion layer, and is then processed with an alkaline processing composition in the presence of a silver halide developing agent. At the time of the processing with the alkaline processing composition in above case, the photosensitive element and the image receiving layer are in such a state that they are superposed upon each other and, as a result of the above processing with the alkaline processing composition, an oxidation product of the silver halide developing agent is formed and thereby the DRR compound is oxidized to release a diffusible dye or its precursor. The diffusible dye or its precursor released from this DRR compound is transferred by diffusion onto the image receiving layer to form a dye image.

Further, in the above-mentioned fourth method, a photosensitive element comprising a light-sensitive silver halide emulsion layer and in combination therewith a non-diffusible dye image forming substance is exposed to light, thereby forming a latent image in said light-sensitive silver halide emulsion layer, and is then processed with an alkaline processing composition in the presence of a silver halide developing agent.

At the time of processing with the alkaline processing composition in the above case, the said photosensitive element and the image receiving layer are in such a state that they are superposed upon each other and, as a result of the above processing with the alkaline processing composition, an oxidation product of the silver halide developing agent is formed, and in the area where said oxidation product is formed, the non-diffusible dye image forming substance is hindered in its releasing a diffusible dye or its precursor on reaction with the oxidation product of the silver halide developing agent. On the other hand, in the area where no oxidation product of the silver halide developing agent is formed, the diffusible dye or its precursor is released from the non-diffusible dye image forming substance and transferred by diffusion onto the image receiving layer to form a dye image.

In the above-mentioned typical first, third and fourth methods, a positive diffusion transfer dye image can be obtained by the use of a negative type silver halide emulsion layer, followed by development treatment. In contradistinction thereto, in the above-mentioned typical second method, a negative diffusion transfer dye image is obtained by the use of a negative type silver halide emulsion layer, followed by development treatment. On that account, it becomes necessary to employ the reversal process in the second method. For instance, a direct positive type emulsion, i.e. an internal latent image type emulsion and a fogged type emulsion, can be used. Alternatively, a negative type silver halide emulsion layer and a layer containing a diffusible dye releasing coupler and a physical developing nucleus, the latter layer being provided adjacent to said emulsion layer, may be processed with a developer containing a silver halide solvent. Further, a layer containing a diffusible dye releasing coupler and a spontaneously reducible metal salt may be provided, said layer being adjacent to a negative type silver halide emulsion layer containing a compound which, on reaction with an oxidation product of a developing agent, releases a development inhibitor such as 1-phenyl-5-mercaptotetrazole. In the present invention, combinations of these emulsions and dye image forming substances may be used and any methods by which negative and positive dye images are obtained can be optionally selected.

The dye image forming substance used in the present invention may be dispersed according to various procedures depending on the type of the substance used in a silver halide emulsion layer in the photosensitive element or in a hydrophilic protective colloid such as gelatin, polyvinyl alcohol or the like which is a carrier of a layer adjacent to said emulsion layer. For instance, a dye image forming substance having a dissociatable group such sulfonyl or carboxyl is first dissolved in water or an aqueous alkaline solution and the resulting solution may be then added to a hydrophilic protective colloid solution. A dye image forming substance which is difficultly soluble in aqueous media and readily soluble in organic solvents is first dissolved in an organic solvent, the resulting solution is added to a hydrophilic protective colloid solution and the resulting colloid solution is stirred or treated with the like means to obtain a dispersion of fine particles of said dye image forming substance. As the organic solvent used in the above case, there may be mentioned high boiling solvents alone or low boiling solvents removable by evaporation from the dispersion product or combinations of organic solvents apt to be soluble in water and said high boiling solvents. Particularly useful as the high boiling solvents in the present invention, are N-n-butylacetanilide, diethyl laurylamide, dibutyl laurylamide, dibutyl phthalate, tricresyl phosphate, triglycerides of higher fatty acids and dioctyl adipate. Usable low boiling solvents include ethyl acetate, methyl acetate, 4-methylcyclohexanone, tetrahydrofuran, methyl ethyl ketone. In order to stabilize the dispersed state of a dye image forming substance, sulfites may be present in the dispersion of a dye image forming substance. Further, the dye image forming substance used in the present invention may be dispersed in its form of particles directly in a hydrophilic colloid without using the high boiling solvent or the like. The amount of the dye image forming substance used in the present invention is preferably, for example, about 0.5 to about 10% by weight based on the coating solution of a hydrophilic protective colloid in which the substance is used, though said amount may be varied widely according to the type of the substance used and to the result as desired.

In preparing a multicolor photographic material according to the present invention, the photosensitive element is advantageously provided with intermediate layers. The intermediate layer not only prevents undesirable interaction taking place between emulsion units different in color sensitivity from each other but also controls diffusibility of a dye image forming substance or an alkaline processing composition. Useful materials for the intermediate layer of the kind include gelatin, calcium arginate, any materials disclosed in U.S. Pat. No. 3,384,383, vinyl acetate-crotonic acid copolymer, isopropylcellulose, hydroxypropylcellulose, polyvinylamides, polyvinylamide graft copolymer and systems of latex liquids and penetrants. This intermediate layer may contain a layer interaction inhibitor which is selected according to the type of the dye image forming substance and of the processing composition used. For instance, in the case of dye image forming substances of the type which release diffusible dyes on reaction with an oxidation product of a developing agent, non-diffusible couplers which react with a reducing agent such as a non-diffusible coupler capable of being fixed on reaction with a reducing agent such as a non-diffusible hydroquinone derivative and an oxidation product are effectively usable for preventing an undesirable exchange of the oxidation product of developing agent between emulsion layer units.

The silver halide emulsion used in the present invention may consist essentially of a colloidal dispersion of silver halide, for example, silver chloride, silver bromide, silver chlorobromide, silver iodobromide, silver chloroiodobromide or mixtures thereof. This silver halide emulsion may comprise either fine or coarse particles of the silver halide and useful are those having an average particle diameter falling within the range of about 0.1 to about 2$\mu$. Further, this silver halide may be prepared by any procedures known, per se, and includes, for example, single jet emulsion, double jet emulsion, Lippmann's emulsion, ammoniacal emulsion, and thiocyanate or thioether ripened emulsion. There may also be used an emulsion comprising silver halide particles having their photosensitivity inside their respective particles. In the present invention, there may be used negative type emulsions or direct positive emulsions.

The silver halide emulsions used in the present invention may be synthesized with a natural sensitizer contained in gelatin or chemical sensitizers, for example, reducing agents, sulfur, selenium or tellurium compounds, gold, platinum or palladium compounds or combinations thereof.

The silver halide emulsions used in the present invention may contain speed increasing compounds, for example, polyalkylene glycol, cationic surface active agents and thioether or combinations thereof. These emulsions can be protected from the formation of fog and stabilized against decrease in sensitivity during storage. Suitable antifoggants and stabilizers which are usable either singly or in combination include thiazorium salts, azaindenes, mercury salts, urazoles, sulfocatechol, oximes, nitron, nitroindazoles, mercaptotetrazoles, polyvalent metal salts, thiuronium salts, palladium, platinum and gold salts.

The silver halide emulsion layer, dye image forming substance-containing layer, dye mordant-containing layer and processing composition permeable layer such as protective or intermediate layer used in the present invention desirably contain a hydrophilic polymer as a binder. Usable hydrophilic polymers include, for example, gelatin, gelatin modified with acylating agents or the like, gelatin grafted with a polyvinyl polymer, protein such as casein or albumin, cellulose derivatives such as hydroxyethylcellulose, hydroxypropylcellulose, methylcellulose and carboxymethylcellulose, partial hydrolyzates of polyvinyl alcohol or polyvinyl acetate, polyvinyl pyrrolidone, polyacrylamide, polyvinyl ethers, high molecular non-electrolytes, e.g. polymethylvinyl ether, partial hydrolyzates of polyacrylic acid or polyacrylamide and anionic synthesized polymers such as a copolymer of vinyl methyl ether and maleic acid, and these hydrophilic polymers may be used singly or in admixture thereof. The layers containing these hydrophilic polymers may further contain a dispersion of latex-like polymer of a hydrophobic monomer such as alkyl acrylate or alkyl methacrylate. In the present invention, these hydrophilic polymers, particularly those having functional groups such as amino, hydroxyl and carboxyl, can be made insoluble by the use of various hardeners without losing their processing composition permeating property. Particularly useful hardeners may include aldehydes such as formaldehyde, glyoxal and glutaraldehyde, N-methylol compounds such as N-hydroxymethylphthalimide and 1-hydroxymethylbenzotriazole, ketones such as 2,5-hexadione and 1,2-cyclopentadione, methylol compounds such as N-polymethylolurea and hexamethylolmelamine, epoxy compounds such as 1,4-bis(2,3-epoxypropoxy)diethyl ether, aziridine compounds such as triethylenephosphamide, and high molecular weight hardeners such as gelatin modified with 3-hydroxy-5-chloro-8-triazinyl. Further, these hydrophilic polymer layers may contain hardening accelerators such as carbonates and resorcinol.

The silver halide emulsions used in the present invention may be incorporated with optical sensitizing dyes in order to impart additional photosensitivity to the emulsions. Optical sensitization can additionally be accomplished by treating the silver halide emulsion with an organic solvent containing a sensitizing dye or by incorporating the emulsion with the sensitizing dye in the form of its dispersion. For obtaining best results, the sensitizing dye is desirably incorporated into the emulsion during the final step of preparing said emulsion or a step more or less preceding thereto. The optical sensitizers effectively usable in the present invention include cyanines, merocyanines, styryls, hemicyanines (e.g. enaminehemicyanine), oxonols and hemioxonols. Cyanine dyes desirably contain, for example, basic nuclei such as thiazoline, oxazoline, pyrroline, pyridine, oxazole, thiazole, selenazole and imidazole. These nuclei may contain an alkyl, alkylene, hydroxyalkyl, sulfoalkyl, carboxyalkyl, aminoalkyl or enamine group, and may be fused to a carbocyclic or heterocyclic ring, and these rings may be substituted or unsubstituted with halogen, or a phenyl, alkyl, haloalkyl, cyano or alkoxy group. The above-mentioned dyes are in the symmetric or assymmetric form and may have on the methylene or polymethine chain a substituent such as an alkyl, phenyl, enamine or heterocyclic group. Merocyanine dyes contain such basic nuclei as mentioned above and such acidic nuclei, for example, as thiohydantoin, rhodanine, oxazolidenedione, thiazolidenedione, barbituric acid, thiazolineone and marononitrile. These acidic nuclei may be substituted with an alkyl, alkylene, phenyl, carboxyalkyl, sulfoalkyl, hydroxyalkyl, alkoxyalkyl or alkylamino group or a heterocyclic nucleus. If desired, the above-mentioned dyes may be used in combination. In the present invention, moreover, the silver halide emulsions may be incorporated, if desired, with hypersensitizing additives which do not absorb visible rays, for example, ascorbic acid derivatives, azaindenes, cadmium salts or organic sulfonic acids.

Usable as the processing composition (an alkaline processing solution) in the present invention, is any of those which are liquid compositions and which contain processing components necessary for the development of the silver halide emulsion and for the formation of a diffusion transfer image. The solvent used for this processing composition, may be any hydrophilic solvent such as water, methanol, methylcellosolve, etc. The processing composition desirably contains an alkali agent in an amount sufficient to maintain a pH value of the system to bring about development of the emulsion layer as well as to neutralize the acid formed during the steps of development and image formation. Usable alkali agents include sodium hydroxide, potassium hydroxide, calcium hydroxide, tetramethylammonium hydroxide, sodium carbonate, trisodium phosphate, diethylamine, etc. The processing composition desirably has a pH value of about 12 or higher at room temperature. The processing composition used in the present invention may be incorporated with thickeners, for example, high molecular thickeners inert to alkali solutions, such as hydroxyethylcellulose, sodium carboxymethylcellulose and the like. The thickener used desirably ranges in concentration from about 1 to 5% by weight based on the weight of the processing composition and thereby to impart a viscosity of about 100 to about 200,000 centipoises to the processing composition, whereby a uniform distribution of the processing composition at the time of processing is facilitated but also when the processing composition becomes thickened as a result of movement during the course of processing of the aqueous medium toward the photosensitive element and image receiving element, a non-fluidizable film is formed to assist the photographic element units to be in a body after processing. The non-fluidizable film, i.e. a polymer film, may also be serviceable, after substantial completion of the formation of a diffusion transfer image, for suppressing a further movement of the dye image forming component toward the image receiving layer and preventing the formed image from an undesirable change. In some cases, the processing composition advantageously contains a light absorbing substance such as carbon black in order to prevent the silver halide emulsion from fogging during processing due to an external light. Further, the processing composition contains processing components indigenous to the image forming substance used. For instance, in the case of the dye developer, the processing composition is desirably incorporated with a codeveloper such as paraaminophenol, 4'-methylphenyl, hydroquinone, 1-phenyl-3-pyrazolidone, etc., an onium type development promoter such as N-benzyl-$\alpha$-picolinium bromide, and an antifoggant such as benzotriazole. Further, in the case of the diffusible dye releasing coupler, the processing composition is desirably incorporated with a developing agent such as an aromatic primary amino color developing agent, an antioxidant such as sulfite or an ascorbic acid or antifoggant such as 5-nitrobenzimidazole, and a silver halide solvent (which term means a solvent capable of dissolving silver halide) such as sodium thiosulfate or sodium thiocyanate.

The photographic materials for the color diffusion transfer process according to the present invention may be subjected to development treatment in the presence of a diffusible onium compound. Such onium compound includes quaternary ammonium compounds, quaternary phosphonium compounds or quaternary sulfonium compounds. Particularly effectively usable as the onium compounds in the present invention, for example, are 1-benzyl-2-picolinium bromide, 1-(3-bromopropyl)-2-picolinium-p-toluenesulfonic acid, 1-phenethyl-2-picolinium bromide, 2,4-dimethyl-1-phenethylpyridinium bromide, $\alpha$-picoline-$\beta$-naphthylmethyl bromide, N,N-diethylpiperidinium bromide, phenethyltrimethylphosphonium bromide, dodecyldimethylsulfonium-p-toluene sulfonate, etc. The onium compound is desirably incorporated into the processing composition (an alkaline processing solution), though it may be used in any location of the photosensitive element and image receiving element.

In the present invention, there may be used a light reflecting substance in order to form a white background of the image formed on the image receiving layer. Suitable light reflecting substances include titanium dioxide, barium sulfate, zinc oxide, alumina barium stearate, calcium carbonate, silicate, zirconium oxide, kaolin, magnesium oxide, etc., and these substances may be used in admixture thereof. Such light reflecting substances may be those which have previously been prepared or may be formed at a predetermined place in the photographic material from precursors thereof which have been incorporated into said photographic material. Further, this light reflecting substance may be incorporated into a layer comprising hydrophilic polymers such as polyvinyl alcohol, gelatin, hydroxypropylcellulose or polyvinyl pyrrolidone or a vinyl polymer containing an anionically soluble group, said hydrophilic polymer and vinyl polymer being used as a binder. Still further, the light reflecting substance may be first added to the processing composition and then fixed in its dispersed state in a layer formed during processing from such film forming polymer as hydroxyethylcellulose or carboxymethylcellulose. In combination with such light reflecting substance, there may be used a fluorescent whitening agent such as stilbene, coumarin, triazine or oxazole. Further, in the present invention there may be used an indicator dye together with the light reflecting substance in order to protect the silver halide emulsion layer during processing from surrounding light.

The processing composition (an alkaline processing solution) used in the present invention is preferably stored in a rupturable receptacle. For instance, the processing composition is stored in a horrow receptacle prepared by folding an air and liquid tight material and sealing each folded edge, so that when the photographic material passes through a compressive tool, the receptacle ruptures at a predetermined place owing to an internal pressure applied to the processing composition contained therein and said processing composition is then released. Advantageously usable materials for forming the above-mentioned receptacle are laminates of polyethylene terephthalate/polyvinyl alcohol/-polyethylene, laminates of tin foil/vinyl chloride-vinyl acetate copolymer and the like. The receptacle is desirably affixed to along the front edge of the photographic material so that the liquid contained in said receptacle is distributed substantially in one direction on the surface of the photosensitive element.

The image receiving element used in the present invention preferably comprises as its surface layer a hydrophilic colloid layer. Desirable hydrophilic colloids include, for example, gelatin, starch, dextrane, polyvinyl pyrrolidone, gum arabic, carboxymethylcellulose, hydroxyethylcellulose, polyvinyl alcohol, guar gum, gum of accasia, etc.

In the present invention, a peeling agent may be used when an image formed is obtained after peeling the photosensitive element and image receiving element from each other. The peeling agent may be incorporated on the surface of the silver halide emulsion layer, on the image receiving layer containing a mordant or into the processing composition. A suitable peeling agent is a binder whose composition is different from those of the binders used in the silver halide emulsions. Useful binders include, for example, alkali permeable polysaccharides, carboxymethylcellulose, hydroxyethylcellulose, hydroxypropylcellulose, 4,4'-dihydroxyphenol, glucose, cane sugar, sorbitol, inositol, resorcinol, sodium salt of phytinic acid, zinc oxide, particulate polyethylene, particulate polyethylene tetrafluoride, and copolymers of polyvinyl pyrrolidone/polyvinyl hydrogen phthalate, and ethylene/maleic anhydride. Further, the hydrophilic colloid surface layer formed on the image receiving element may be incorporated with an ultraviolet absorbing substance. Furthermore, this surface layer may be incorporated with a fluorescent whitening agent such as stilbene, coumarin, triazine, oxazole or the like, if desired.

The layers constituting the photographic material used in the present invention, said material comprising the photosensitive element, image receiving element and processing sheet, may be incorporated, if necessary, with surface active agents, for example, saponin, anionic compounds, e.g. alkylarylsulfonates, amphoteric compounds, for example, those as disclosed in U.S. Pat. No. 3,133,816, and water soluble adducts of glycidol and alkylphenol.

Further, in order to facilitate the coating operation of the constitutive layers of the photographic material according to the present invention, the coating compositions may be incorporated with various thickeners and the above-mentioned surface active agents. For instance, effectively usable in the present invention are anionic polymers such as high molecular weight polyacrylamides or acrylic acid type polymers which demonstrate a thickening action on interaction with a binder polymer present in the coating composition.

The photographic material according to the present invention may be coated according to various coating techniques, for example, dip coating method, air knife method, curtain coating method or extrusion coating method using a hopper, and two or more layers may be coated simultaneously, if desired. The present invention is applicable also to silver halide layers to be formed according to vacuum evaporation coating.

The constitutive layers of the photographic material according to the present invention may be hardened by various organic or inorganic hardeners used singly or in combination. Suitable hardeners include, for example, aldehydes, blocked aldehydes, ketones, carboxylic acid derivatives, carbonic acid derivatives, sulfonates, esters, sulfonylhalides, vinylsulfonyl ethers, active halogen compounds, epoxy compounds, aziridines, active olefins, isocyanates, carbodiimides, mixed functional hardeners and polymer hardeners, for example, saponified polysaccharides such as dialdehyde starch and oxyguar gum.

Usable sensitizing dyes and other additives in the present invention, may be used in the form of aqueous solutions or alternatively used by the addition thereto of suitable organic solvents.

The photographic material according to the present invention may contain, for example, light absorbing substance and filter dyes, and these compounds may act as mordant, if desired.

The present invention is concretely illustrated further below with reference to examples, but it should be construed that embodiments of the invention are not limited to these examples. Before illustrating the examples, the process for synthesizing the polymer mordants of the present invention is explained hereinafter.

Synthesis Example 1-A (Synthesis of exemplified compound [1])

Preparation of poly(divinylbenzene-co-styrene-co--4-vinylpyridine (Mole ratio, x:y:z=2:49:49)

A reaction vessel charged with 400 g of distilled water and flushed with nitrogen gas, followed by heating in a nitrogen atmosphere to 60° C. Subsequently, to the reaction vessel were added 7.25 ml of Triton 770 (a 30% aqueous solution of a surfactant produced and sold by Rohm & Hass) represented by the following formula,

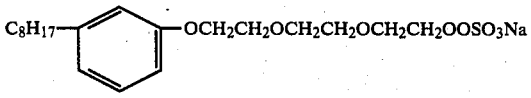

25.52 g of styrene, 25.76 g of 4-vinylpyridine and 2.37 g (actually containing 55% of the main component) divinylbenzene, and simultaneously were added a deaerated solution of 0.405 g of potassium persulfate in 15 ml of distilled water and a deaerated solution of 0.203 g of sodium hydrogen sulfite in 7 ml of distilled water. The contents of the reaction vessel were then heated with stirring for 5 hours.

The resulting mixture was cooled down to 25° C. and then filtered to obtain a latex having a 10% solids content and a solution viscosity (as measured with a Brookfield type viscometer) of 8 cps.

Synthesis Example 1-B

Preparation of poly(divinylbenzene-co-styrene-co-4-vinylpyridine) (Mole ratio, 2:49:49)

A reaction vessel charged with 400 g of distilled water was flushed with nitrogen gas, followed by heating in a nitrogen atmosphere to 60° C. Subsequently, to the reaction vessel were added 7.25 ml of Triton 770 (30% solution), 25.52 g of styrene, 25.76 g of 4-vinylpyridine and 2.37 g (actually containing 55% of the main component) of divinylbenzene, and simultaneously was added a deaerated solution of 0.27 g of azobis(cyanovaleric acid) in 15 ml of 1 N aqueous NaOH solution. The contents of the reaction vessel were then heated with stirring for 5 hours.

The resulting mixture was cooled down to 25° C. and then filtered to obtain a latex having a 10% solids content and a solution viscosity (as measured with a Brookfield type viscometer) of 7.6 cps.

Synthesis Examples 2–6

The same procedure as in Synthesis Example 1-B was repeated to obtain a series of lattices, except that the comonomers used were n-butyl methacrylate, ethyl acrylate, acrylonitrile, methylstyrene and acrylamide, respectively. The thus obtained polymers were as shown below, and the mole ratio, analytical values and viscosity of each of these polymers were as shown in Table 1.

Synthesis Example 2 (Synthesis of exemplified compound [2])

Poly(divinylbenzene-co-n-butyl methacrylate-co-4-vinylpyridine)

Synthesis Example 3

Poly(divinylbenzene-co-ethyl acrylate-co-4-vinylpyridine)

Synthesis Example 4 (Synthesis of exemplified compound [3])

Poly(divinylbenzene-co-acrylonitrile-co-4-vinylpyridine)

Synthesis Example 5

Poly(divinylbenzene-co-p-methylstyrene-co-vinylpyridine)

Synthesis Example 6

Poly(divinylbenzene-co-acrylamide-co-vinylpyridine)

TABLE 1

| Synthesis example | Mole ratio | | | Analytical value | | | Viscosity[b] (cps) |
|---|---|---|---|---|---|---|---|
| | x[a] | y[a] | z[a] | C | H | N | |
| 2 | 2 | 49 | 49 | 75 | 8.5 | 5.5 | 4 |
| 3 | 2 | 49 | 49 | 69.5 | 7 | 13 | 11 |
| 4 | 2 | 59 | 39 | 76 | 6 | 18 | 9 |
| 5 | 1 | 50 | 49 | 86 | 8 | 6 | 8 |
| 6 | 3 | 37 | 60 | 71.5 | 7 | 1.5 | 14 |

[a]Mole ratio of the monomer fed.
[b]Measurement was conducted by the use of a Brookfield rotary viscometer (the same shall apply hereinafter).

EXAMPLE 1

A mixture comprising 8 g, in terms of polymer solids content, of each polymer lattice obtained in Synthesis Examples 1–6, 8 g of gelatin, 0.6 mg of mucochloric acid and 0.75 ml of a 10% Emulgen-108 was added to dissolve therein so as to obtain a solution of 250 ml. The thus obtained solution was coated on a polyethylene terephthalate support 100μ thick so that the amounts of the polymer and gelatin were 27 mg/100 cm$^2$ and 27 mg/100 cm$^2$, respectively.

COMPARATIVE EXAMPLE A

According to the procedure disclosed in U.S. Pat. No. 3,148,061, poly-4-vinylpyridine was prepared, the polymer was then charged with a small amount of acetic acid according to Example 1 thereof and was coated on a transparent polyethylene terephthalate support 100μ thick.

The coating liquids used in this example and Comparative Example A had the respective viscosities as shown in Table 2.

TABLE 2

| | Synthesis example | Viscosity (cps)[b] |
|---|---|---|
| Example 1 | 1 | 8 |
| | 2 | 14 |
| | 3 | 10 |
| | 4 | 9 |
| | 5 | 18 |
| | 6 | 20 |
| Comparative example A | | Note 1 |

Note 1:
Viscosity of the coating liquid was too high to measure with a Brookfield rotary viscometer.

The coatings formed on the samples by the use of the compounds of Example 1 were found transparent and uniform, and no particular difficulty in coating was observed. In contrast thereto, the coating liquid containing the compound of Comparative Example A was markedly high in viscosity and could be coated on the support with extreme difficulty to form a coating which was found, when dried, to lack uniformity. Further, the coating assumed a yellow color and bore the odor of acid.

EXAMPLE 2

The image receeiving elements as prepared in Example 1 and Comparative Example A were individually coated with the following layers to prepare integral multi-layered monochromatic photosensitive elements (1)–(6) and (A).

[1] A light reflection layer having a dry film thickness of 7 to 8μ and comprising titanium dioxide (220 mg/100 cm$^2$) and gelatin (22 mg/100 cm$^2$).

[2] An opacifying layer having a dry film thickness of 4μ and comprising carbon black (28 mg/100 cm²) and gelatin (18 mg/100 cm²).

[3] A layer containing a cyan dye image forming material having a dry film thickness of 2.2μ and comprising a DRR compound (0.01 mM/100 cm²) of the following formula, N,N-dimethyl laurylamide (11 mg/100 cm²) and gelatin (25.0 mg/100 cm²).

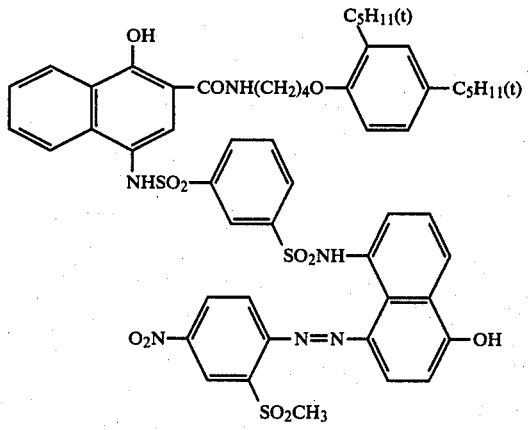

[4] A red-sensitive emulsion layer having a dry film thickness of 1.5μ and comprising a red-sensitive direct positive internal image silver bromide emulsion (14.3 mg/100 cm² in terms of silver), potassium 2-octadecylhydroquinone-5-sulfonate (0.9 mg/100 cm²), formyl-4'-methylphenylhydrazide (0.13 mg/100 cm²) and gelatin (16.5 mg/100 cm²).

[5] A protective layer having a dry film thickness of 0.7μ and comprising mucochloric acid (1.0 mg/100 cm²) and gelatin (10.0 mg/100 cm²).

Subsequently, a processing sheet was prepared by coating in succession the following layer on a transparent polyethylene terephthalate film support of 100μ thick.

[1] A neutralization layer having a dry film thickness of 22.0μ and comprising a copolymer of acrylic acid and ethyl acrylate (75/25 weight %), (220 mg/100 cm²).

[2] A timing layer having a dry film thickness of 5.0μ and cellulose diacetate (acetyl value 40%), (50 mg/100 cm²).

The thus prepared integral multi-layered monochromatic photosensitive elements were individually exposed to light in a given amount through an optical wedge, which is made of silver wedges of 30 steps and has a difference in density at every step of 0.15, and then thereon was superposed the above-mentioned processing sheet, while affixing therebetween a pod containing 1 ml of an alkaline processing composition, to prepare photographic materials. Subsequently, each of the thus prepared photographic materials were passed through a pair of compressedly juxtaposed rollers having a space of about 340μ therebetween, thereby to rupture the pod and spread the contents thereof between said photosensitive element and said processing sheet.

The alkaline processing composition used herein had the following constituents.

| | |
|---|---|
| Potassium hydroxide | 56 g |
| Sodium sulfite | 2.0 g |
| 4-Hydroxymethyl-4-methyl-phenyl-3-pyrazolidone | 8.0 g |

-continued

| | |
|---|---|
| 5-Methyl benzotriazole | 2.8 g |
| Carbon black (Raven - 450, Columbia Carbon Co.) | 150 g |
| Carboxymethyl cellulose sodium salt (High viscosity type, Tokyo Kasei K.K.) | 50.0 g |
| Benzyl alcohol | 1.5 ml |
| Distilled water to make | 1000 ml |

After the lapse of several minutes, a dye image was observed through the transparent support of the photosensitive element.

The dye images formed on the photosensitive elements respectively were individually measured in reflection density (with a photoelectric densitometer of Model PDA-60, manufactured by Konishiroku Photo Industry, Co., Ltd.) by means of a red filter (λmax=644 nm) to obtain the results as shown in Table 3.

TABLE 3

| Photosensitive element | Reflection density Maximum (Dmax) | Reflection density Minimum (Dmin) | Transfer time ($t_{0.5}$)* |
|---|---|---|---|
| (1) | 1.89 | 0.21 | 3' 14" |
| (2) | 1.86 | 0.23 | 3' 27" |
| (3) | 1.78 | 0.23 | 3' 12" |
| (4) | 1.69 | 0.19 | 3' 15" |
| (5) | 1.88 | 0.22 | 3' 13" |
| (6) | 1.72 | 0.26 | 3' 47" |
| (A) | 1.63 | 0.29 | 4' 59" |

Note:
*The transfer time $t_{0.5}$ indicates a time required for attaining a density of 50% of the maximum transferred density as measured at the time when 60 minutes passed after the processing (the same shall apply hereinafter), and this transfer time is useful as a quick guide to the dye image forming speed.

It is well known to those skilled in the art that polymers considered to have good mordant performance should have not only high mordant ability but also quick dye image forming speed.

As is clear from the results shown in Table 3, it is understood that when compared with Comparative Example (A), the photosensitive elements comprising the present polymer mordants are equal or superior in maximum reflection density (Dmax) to the element of Comparative Example (A) and are satisfactorily kept low in minimum reflection density (Dmin), and further that the present polymer mordants are favorable in dye image forming time and thus are found to be markedly improved mordants.

EXAMPLE 3

The samples as prepared in Example 1 were individually coated in succession on the surface with the following layers to prepare integral multi-layered monochromatic photosensitive elements (7)–(12) and (A)'.

[1] A light reflection layer having a dry film thickness of 7–8μ and comprising titanium dioxide (220 mg/100 cm²) and gelatin (22 mg/100 cm²).

[2] An opacifying layer having a dry film thickness of 4μ and comprising carbon black (28 mg/100 cm²) and gelatin (18 mg/100 cm²).

[3] A layer comprising 10.2 mg/100 cm² (calculated as silver) of a red-sensitive silver iodobromide emulsion (average particle size, 0.8μ) containing 2 mol% of silver iodido, 1-phenyl-4-hydroxymethyl-4-methyl-3-pyrazolidone (0.5 mg/100 cm²), gelatin (22.0 mg/100 cm²), a non-diffusible dye image forming material (0.005 mM/100 cm²), of the following formula and N,N-diethyl laurylamide (10 mg/100 cm²).

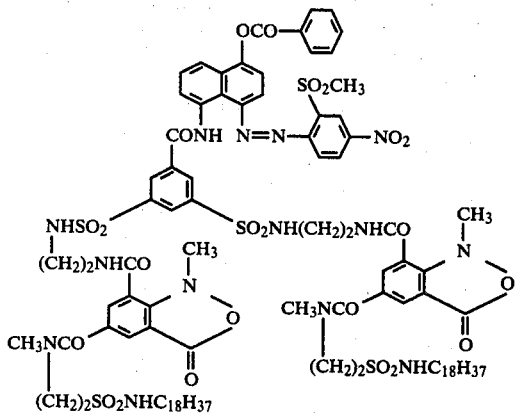

[4] A protective layer comprising gelatin (10.0 mg/100 cm²) and mucochloric acid (1.2 mg/100 cm²).

The samples thus prepared were individually exposed to light in the same manner as in Example 2 and thereon was superposed the same processing sheet as in Example 2, while affixing therebetween a pod containing about 1.0 ml of an alkaline processing composition, to prepare photographic materials. Subsequently, each of the photographic materials thus prepared was passed through between a pair of compressedly juxtaposed rollers having a space of about 340μ therebetween, thereby to rupture the pod and spread the contents thereof between said photosensitive element and said processing sheet.

The alkaline processing composition used herein had the following constituents.

| (Alkaline processing composition) | |
|---|---|
| Potassium hydroxide | 70 g |
| Sodium hydrogen sulfite | 2 g |
| 1-Phenyl-4-hydroxymethyl-4-methyl-pyrazolidone | 5 g |
| Potassium bromide | 20 g |
| Carboxymethylcellulose sodium salt (High viscosity type, produced by Tokyo KaseiK.K.) | 50 g |
| Carbon black (Raven-450, Columbia Carbon Co.) | 150 g |
| Distilled water to make | 1000 ml |

After several minutes, a cyan dye image was observed on each photosensitive element through the transparent support thereof. Each dye image thus obtained was measured in reflection density with a Sakura Photoelectric densitometer of Model PDA-60) using a red filter (λmax=644 nm) to obtain the results as shown in Table 4.

TABLE 4

| Photo-sensitive element | Reflection density Maximum (Dmax) | Reflection density Minimum (Dmin) | Transfer time ($t_{0.5}$) |
|---|---|---|---|
| (7) | 2.13 | 0.21 | 7' 12" |
| (8) | 2.24 | 0.26 | 6' 21" |
| (9) | 2.18 | 0.19 | 6' 03" |
| (10) | 2.30 | 0.28 | 7' 08" |
| (11) | 2.21 | 0.18 | 6' 47" |
| (12) | 2.09 | 0.17 | 6' 54" |
| (A)' | 2.02 | 0.31 | 8' 44" |

As is clear from Table 4, the image receiving elements (7)–(12) according to the present invention are not only high in Dmax and low in Dmin but also favorable in transfer speed and free from color bleeding. In contrast thereto, Comparative Example (A)' is low in transfer speed and found unsatisfactory with respect to Dmax as well as Dmin and, at the same time, distorted portions were observed in the dye image formed on the image receiving element thereof.

EXAMPLE 4

The image receiving elements as prepared in Example 1 were individually coated in succession on the surface with the following layers to prepare integral multi-layered monochromatic photosensitive elements.

[1] A light reflection layer having a dry film thickness of 7–8μ and comprising titanium dioxide (220 mg/100 cm²) and gelatin (22 mg/100 cm²).

[2] An opacifying layer having a dry film thickness of 4μ and comprising carbon black (28 mg/100 cm²) and gelatin (18 mg/100 cm²).

[3] A scavenger layer having a dry film thickness of 2–1.5μ and comprising as a mordant one of the exemplified compounds of the present invention (0.8 mg/100 cm²) shown in Table 5, and gelatin (10.5 mg/100 cm²).

[4] A cyan dye image forming material containing a layer having a dry film thickness of 2.2μ and comprising DRR material (0.01 mM/100 cm²) of the following formula, N,N-dimethyl laurylamide (11 mg/100 cm²) and gelatin (25.0 mg/100 cm²).

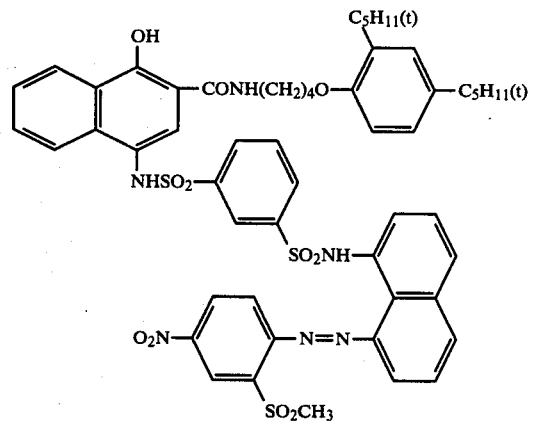

[5] A red-sensitive emulsion layer having a dry film thickness of about 1.5 μm and a red-sensitive direct positive internal image silver bromide emulsion (14.3 mg/100 cm² in terms of silver), potassium 2-octadecylhydroquinone-5-sulfonate (0.9 mg/100 cm²), formyl-4'-methylphenylhydrazide (0.13 mg/100 cm²), and gelatin (16.5 mg/100 cm²).

[6] A protective layer having a dry film thickness of 0.7μ and comprising mucochloric acid (1.0 mg/100 cm²) and gelatin (10.0 mg/100 cm²).

Subsequently, a processing sheet was prepared by successively coating the following layers on a transparent polyethylene terephthalate film support of a 100μ thick.

[1] A neutralization layer having a dry film thickness of 22.0μ and comprising a copolymer of acrylic acid and n-butyl acrylate (weight proportion; 75/25, Mn=70,000) (220 mg/100 cm²).

[2] A timing layer having a dry film thickness of 5μ and comprising cellulose diacetate (acetyl value 40%) 50 mg/100 cm²).

Comparative Example B was used, which was prepared in the same manner as above, except that the scavenger layer was formed by using only gelatin without incorporating therein any mordant.

The thus prepared integral multi-layered monochromatic photosensitive elements were individually exposed to light in a given amount through an optical wedge, which is made of silver wedges of 30 steps and has a difference in density at every step of 0.15, and then thereon was superposed the above-mentioned processing sheet while afixing therebetween a pod containing 1 ml of a processing composition containing the following constituents. Each of the thus prepared film units was passed through a pair of compressedly juxtaposed rollers having a space of about 340μ therebetween, thereby to rupture the pod and spread the contents thereof over between said photosensitive element and said processing sheet.

The following are constituents of the processing composition used herein.

| | |
|---|---|
| Potassium hydroxide | 56 g |
| Sodium sulfite | 2.0 g |
| 4-Hydroxymethyl-4-methyl-phenyl-3-pyrazolidone | 8.0 g |
| 5-Methylbenzotriazole | 2.8 g |
| Carboxymethylcellulose sodium salt | 50.0 g |
| Carbon black (Raven-450, Columbia Carbon Co.) | 150 g |
| Benzyl alcohol | 1.5 ml |
| Distilled water to make | 1000 ml |

After several minutes, a dye image formed on the photosensitive element was observed through the transparent support.

Each of the dye images thus obtained was measured in reflection density (using Sakura Photoelectric densitometer Model PDA-60 manufactured by Konishiroku Photo Industry Co., Ltd.) by means of a red filter (λmax=644 nm) to obtain the results as shown in Table 5.

TABLE 5

| Photo-sensitive element | Cyan color density | | | |
|---|---|---|---|---|
| | Maximum (Dmax) | Minimum (Dmin) | $t_{0.5}$ | Dmin 1 day/Dmin |
| Comparative Example B | 1.89 | 0.21 | 3' 14" | 1.24 |
| Exemplified compound (1) | 1.86 | 0.14 | 3' 16" | 1.07 |
| Exemplified compound (2) | 1.90 | 0.15 | 3' 15" | 1.07 |
| Exemplified compound (3) | 1.84 | 0.16 | 3' 12" | 1.13 |
| Exemplified compound (4) | 1.91 | 0.17 | 3' 18" | 0.94 |
| Exemplified compound (5) | 1.82 | 0.11 | 3' 12" | 1.09 |

As is clear from Table 5, it is understood that when compared with Comparative Example (B), the scavenger layers (1)-(5) according to the present invention successfully keep Dmin values at a lower level without decreasing Dmax values.

Furthermore, it is understood that in the photosensitive elements according to the present invention the transfer speed is normally maintained in each case without lowering $t_{0.5}$ values which are usually affected by the lowering of Dmin.

From the Dmin 1 day/Dmin ratio as obtained in each case of the photosensitive elements of the present invention, it is understood that the dye which had been once retained in the scavenger layer did not affect adversely the image formed by diffusion transfer.

What we claim is:

1. A color diffusion transfer photographic material comprising a support, a photosensitive layer containing a silver halide emulsion, at least one layer containing a dye mordant and at least one layer containing a dye image forming substance wherein the dye mordant-containing layer comprises a water-dispersible particulate polymer mordant comprising units represented by the general formula:

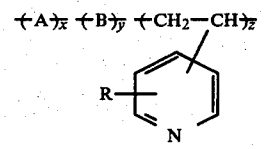

wherein A is a polymerized monomer unit containing at least 2 ethylenically unsaturated groups; B is a polymerized copolymerizable α,β-ethylenically unsaturated monomer unit; and R is a hydrogen atom or a methyl or ethyl group; x, y and z individually represent a mole proportion, and x is 1-3 mol %, y is 7-49 mol % and z is 50-90 mol %.

2. A color diffusion transfer photographic material according to claim 1 wherein the dye image forming substance-containing layer is the photosensitive layer which contains a silver halide photographic emulsion in addition to the dye image forming substance, and the photographic material is an integral multi-layered negative type photographic material which comprises a support, at least one photosensitive layer mentioned above and at least one dye mordant-containing layer as defined in claim 1.

3. A color diffusion transfer photographic material comprising a support, a photosensitive layer containing a silver halide emulsion, at least one layer containing a dye mordant and at least one layer containing a dye image forming substance wherein the dye mordant-containing layer comprises a water-dispersible particulate polymer mordant comprising units represented by the general formula:

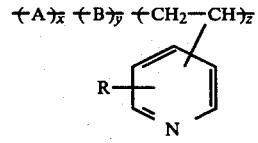

wherein A is di-vinylbenzene, B is selected from the group consisting of styrene, butyl methacrylate, ethyl acrylate, acrylonitrile, p-methylstyrene and acrylamide and R is a hydrogen atom; and x is 1-3 mol%, y is 37-59 mol% and z is 39-60 mol%.

* * * * *